US006997793B1

(12) United States Patent
Ito

(10) Patent No.: US 6,997,793 B1
(45) Date of Patent: Feb. 14, 2006

(54) POLISHING PAD, POLISHING APPARATUS HAVING THE SAME, AND BONDING APPARATUS

(75) Inventor: Toshiyuki Ito, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 0 days.

(21) Appl. No.: 10/992,745

(22) Filed: Nov. 22, 2004

(30) Foreign Application Priority Data

Jul. 20, 2004 (JP) ..... 2004-211799

(51) Int. Cl.
*B24D 11/00* (2006.01)

(52) U.S. Cl. ..... 451/527; 451/530

(58) Field of Classification Search ..... 451/526–539; 438/692, 693

See application file for complete search history.

(56) References Cited

U.S. PATENT DOCUMENTS 5,882,251 A * 3/1999 Berman et al. ..... 451/527
6,165,904 A * 12/2000 Kim ..... 438/692
6,241,596 B1 * 6/2001 Osterheld et al. ..... 451/527
6,273,806 B1 * 8/2001 Bennett et al. ..... 451/527
6,331,137 B1 * 12/2001 Raeder et al. ..... 451/285
6,699,115 B1 * 3/2004 Osterheld et al. ..... 451/527

OTHER PUBLICATIONS

Patent Abstracts of Japan, No. 10071561 A, date Mar. 17, 1998. Cited in the specification.

* cited by examiner

*Primary Examiner*—Dung Van Nguyen
(74) *Attorney, Agent, or Firm*—Westerman, Hattori, Daniels & Adrian, LLP

(57) ABSTRACT

A plurality of projections and grooves are formed on a polishing member. The grooves are formed in grid pattern. A portion on which the grooves and the projections are formed (polishing portion) has a substantially circular shape in a plane view. Around the polishing portion, an outer peripheral portion having a fixed height is provided. The height of the outer peripheral portion is equal to the height of bottom portions of the grooves. Ends of each of the grooves extend to the outer peripheral portion, which allows slurry and the like entering the grooves to flow outside via the outer peripheral portion. When a polishing pad thus structured is to be bonded to a surface plate, adhesive is applied or a double-stick tape is affixed to a rear surface of a base member, and thereafter, the polishing pad is put in place on the surface plate. Next, the polishing portion is pressed to the surface plate from an upper side, and subsequently the outer peripheral portion is pressed to the surface plate from the upper side.

11 Claims, 7 Drawing Sheets

POLISHING PAD, POLISHING APPARATUS HAVING THE SAME, AND BONDING APPARATUS

CROSS-REFERENCE TO RELATED APPLICATIONS

This application is based upon and claims the benefit of priority from the prior Japanese Patent Application No. 2004-211799, filed on Jul. 20, 2004, the entire contents of which are incorporated herein by reference.

BACKGROUND OF THE INVENTION

1. Field of the Invention

The present invention relates to a polishing pad suitable for chemical mechanical polishing (CMP), a polishing apparatus having the same, and a bonding apparatus.

2. Description of the Related Art

Conventionally, a semiconductor integrated circuit has been formed by depositing insulating layers, conductive layers, and so forth on a silicon wafer. Each layer is etched during the formation processes. As a result, steps are formed in each layer. With such steps, even the same layer has a highly conductive portion and a low conductive portion, so that a desired electrical characteristic cannot be obtained. Therefore, planarization by CMP is performed after etching when necessary.

For performing CMP, a polishing pad is bonded to a CMP apparatus. Polishing pads in various shapes are available, and for example, those having grooves arranged along the circumference, those having grooves arranged in grid pattern, and so on are available.

FIG. 6A and FIG. 6B are schematic views showing an example of a conventional polishing pad (first conventional example). Note that FIG. 6B shows a cross section taken along the I—I line in FIG. 6A. The first conventional example, which has a double-layer structure, is composed of a base member 101 to be bonded to a surface plate 10 and a polishing member 102 having irregularities formed on a front surface thereof. On the polishing member 102, a plurality of projections 102*b* and grooves 102*a* are formed. The grooves 102*a* are formed in grid pattern, each having a rectangular cross section. Ends of each of the grooves 102*a* extend to the outside of the polishing member 102 to allow slurry and the like entering the inside of the grooves 102*a* to flow outside. A polishing portion 103 covers the entire polishing pad in a plane view.

The first conventional example as described above, however, has a problem of poor bondability to the surface plate 10. This is because the grooves 102*a* are formed on the entire polishing pad, and portions in which the grooves 102*a* are formed in particular are poor in bondability. Consequently, small gaps are formed between the portions in which the grooves 102*a* are formed and the surface plate 10, and the slurry and the like enter the gaps. If the slurry and the like enter, adhesive strength further lowers, sometimes resulting in peeling of the polishing pad off the surface plate 10 during the polishing. This sometimes causes in the worst case the breakage of a silicon wafer. Another problem is that abrasive and the like contained in the slurry remain on the surface plate 10 when the polishing pad is peeled off after the polishing is finished. The residual abrasive and the like will obstruct ensuring high planarity when the polishing pad is bonded the next time, so that a wafer cannot be sufficiently planarized.

Therefore, a polishing pad with improved bondability has been proposed. FIG. 7A and FIG. 7B are schematic views showing another example of a conventional polishing pad (second conventional example). Note that FIG. 7B shows a cross section taken along the I—I line in FIG. 7A. In the second conventional example, a wall portion 104 is formed around a polishing portion 103. Further, grooves 102*b* have the same depth in a center portion but in areas close to the wall portion 104, the grooves 102*b* closer to the wall portion 104 have shallower depth.

According to the second conventional example as described above, since it is possible to inhibit the deterioration of bondability of the portions in which the shallow grooves 102*a* are formed, the aforesaid peeling and entering of slurry and the like can be inhibited. However, the existence of the wall portion 104 outside the grooves 102*a* makes it difficult to discharge the slurry and the like that have entered the inside of the grooves 102*a*. Consequently, an excessive amount of the slurry and the like may possibly stay in the polishing portion 103, which sometimes causes a scratch and the like on a wafer during the polishing.

A related art is described in Japanese Patent Application Laid-open No. 10-71561.

SUMMARY OF THE INVENTION

An object of the present invention is to provide a polishing pad whose bondability to a surface plate can be improved, a polishing apparatus having the same, and a bonding apparatus.

The inventor of the present application has come up with various forms of the invention described below as a result of assiduous study for solving the above-described problems.

A polishing pad according to the present invention includes: a polishing portion having a plurality of projections that are brought into contact with an object to be polished and grooves formed between the plurality of projections; and an outer peripheral portion provided around the polishing portion and having a front surface lower in height than top portions of the projections. A polishing apparatus according to the present invention includes the polishing pad.

A bonding apparatus according to the present invention is a bonding apparatus that bonds a polishing pad to a surface plate of a polishing apparatus. The polishing pad includes: a polishing portion having a plurality of projections that are brought into contact with an object to be polished and grooves formed between the plurality of projections; and an outer peripheral portion provided around the polishing portion and having a front surface lower in height than top portions of the projections. The bonding apparatus includes: a jig to be in contact with the outer peripheral portion; and a vertical movement unit that moves the jig in a direction perpendicular to the front surface of the polishing pad.

DETAILED DESCRIPTION OF THE PREFERRED EMBODIMENTS

Figure 1A:
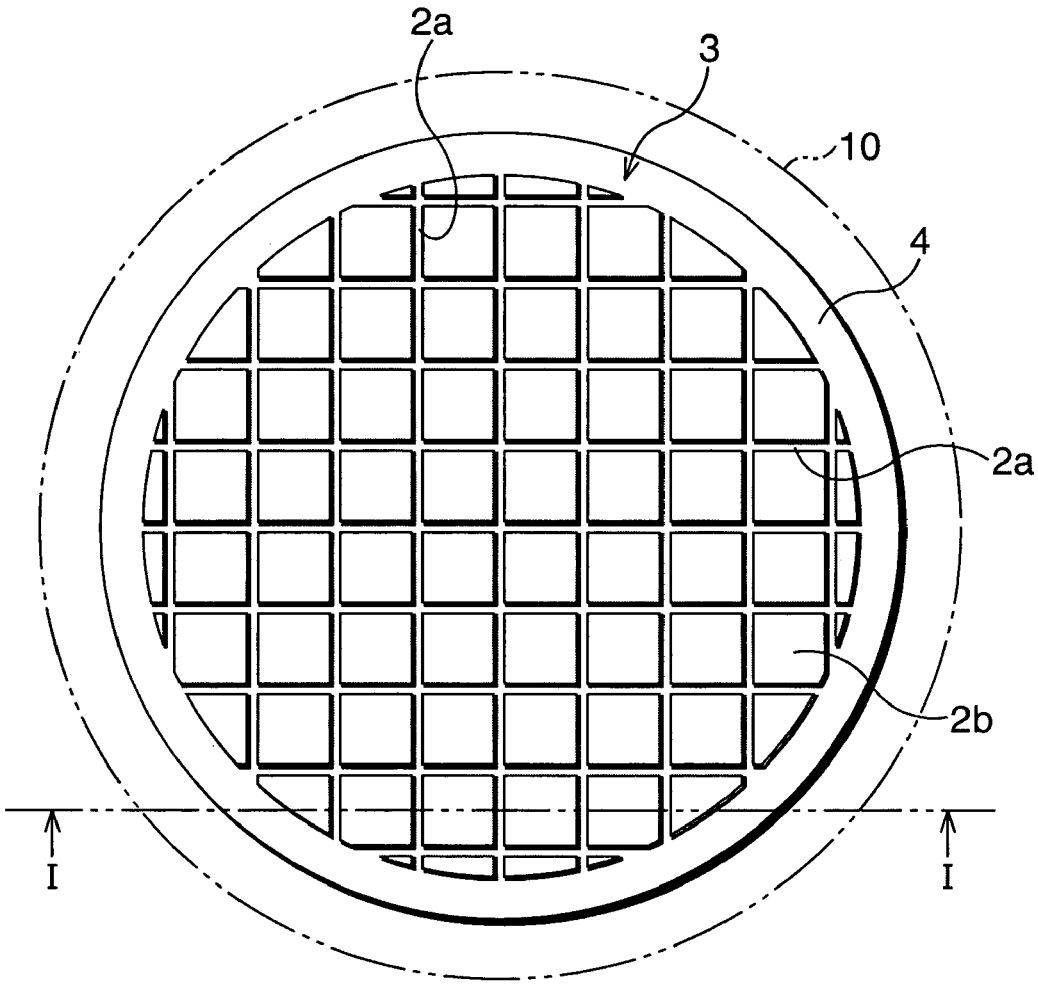
FIG. 1A and FIG. 1B are schematic views showing a polishing pad according to an embodiment of the present invention.
Figure 1B:
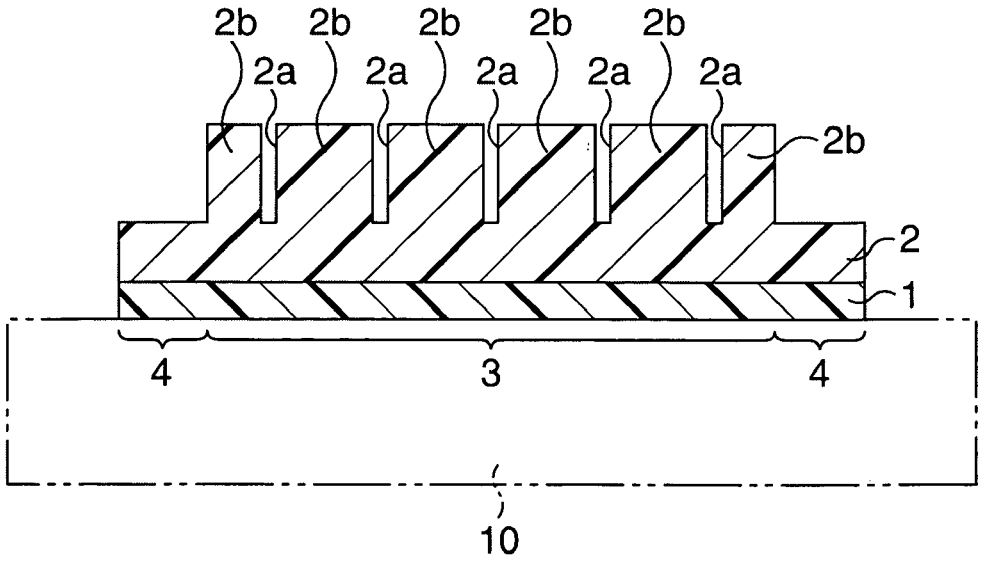

Hereinafter, an embodiment of the present invention will be concretely described with reference to the attached drawings. FIG. 1A and FIG. 1B are schematic views showing a polishing pad according to the embodiment of the present invention. Note that FIG. 1B shows a cross section taken along the I—I line in FIG. 1A.

The polishing pad according to the present embodiment has a base member 1 to be bonded to a surface plate 10 and a polishing member 2 having irregularities formed on a front surface thereof. The base member 1 and the polishing member 2 are made of, for example, foamed polyurethane. A plurality of projections 2*b* and grooves 2*a* are formed on the polishing member 2. The grooves 2*a* are formed, for example, in grid pattern, each having a rectangular cross section. A portion on which the grooves 2*a* and the projections 2*b* are formed (polishing portion 3) is in a substantially circular shape in a plane view. Further, an outer peripheral portion 4 with a fixed height is provided around the polishing portion 3. The height of the outer peripheral portion 4 is, for example, equal to the height of bottom portions of the grooves 2*a*. Ends of each of the grooves 2*a* extend to the outer peripheral portion 4 so as to allow slurry and the like entering the inside of the grooves 2*a* to flow outside via the outer peripheral portion 4.

When the polishing pad according to the present embodiment thus structured is to be bonded to the surface plate 10, for example, adhesive is applied or a double-stick tape is affixed to a rear surface of the base member 1, and thereafter, the polishing pad is put in place on the surface plate 10. Next, the polishing portion 3 is pressed to the surface plate 10 from an upper side. Subsequently, the outer peripheral portion 4 is pressed to the surface plate 10 from the upper side.

Such bonding of the polishing pad to the surface plate 10 can realize high bondability. Pressing of only the polishing portion 3 to the surface plate 10 would result in low bondability in the outer peripheral portion 4, so that the slurry and the like may possibly enter between the polishing pad and the surface plate 10. However, the subsequent pressing of the outer peripheral portion 4 to the surface plate 10 side results in improved bondability in the outer peripheral portion 4. In the first conventional example, pressing from its center toward an outer side could also prevent, though only slightly, the slurry and the like from entering, but sufficient inhibition is not possible. This is because, in the first conventional example, the polishing portion 103 covers the entire polishing pad and thus the projections 102*b* also exist in its rim portion, which makes it difficult to sufficiently press the polishing pad. In the present embodiment, on the other hand, the outer peripheral portion 4 is formed to be equal in height to the bottom portions of the grooves 2*a*, which makes it possible to sufficiently press the outer peripheral portion 4 to sufficiently prevent the slurry and the like from entering inside. Therefore, a polishing apparatus, in particular, a CMP apparatus not easily causing a scratch or the like in a wafer can be realized.

The high bondability prevents the polishing pad from easily peeling off while the wafer is polished and can reduce the breakage of the wafer caused by this peeling. Further, the reduction of peeling can greatly increase the number of wafers processable with one polishing pad. Moreover, the frequency of replacing the polishing pads can be lowered, so that running cost can be also reduced.

Figure 2:
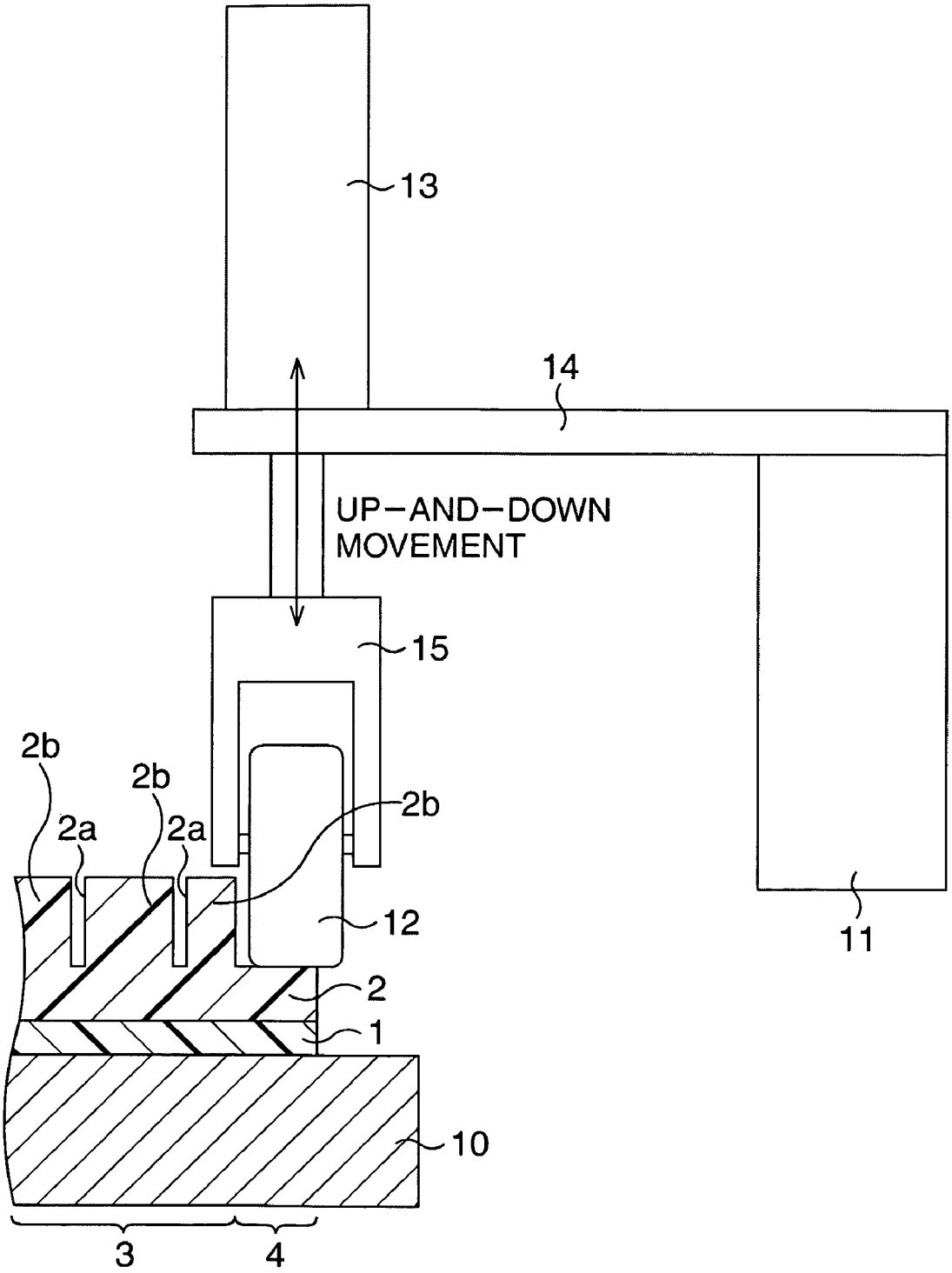
FIG. 2 is a front view showing a bonding apparatus for the polishing pad.
Figure 3:
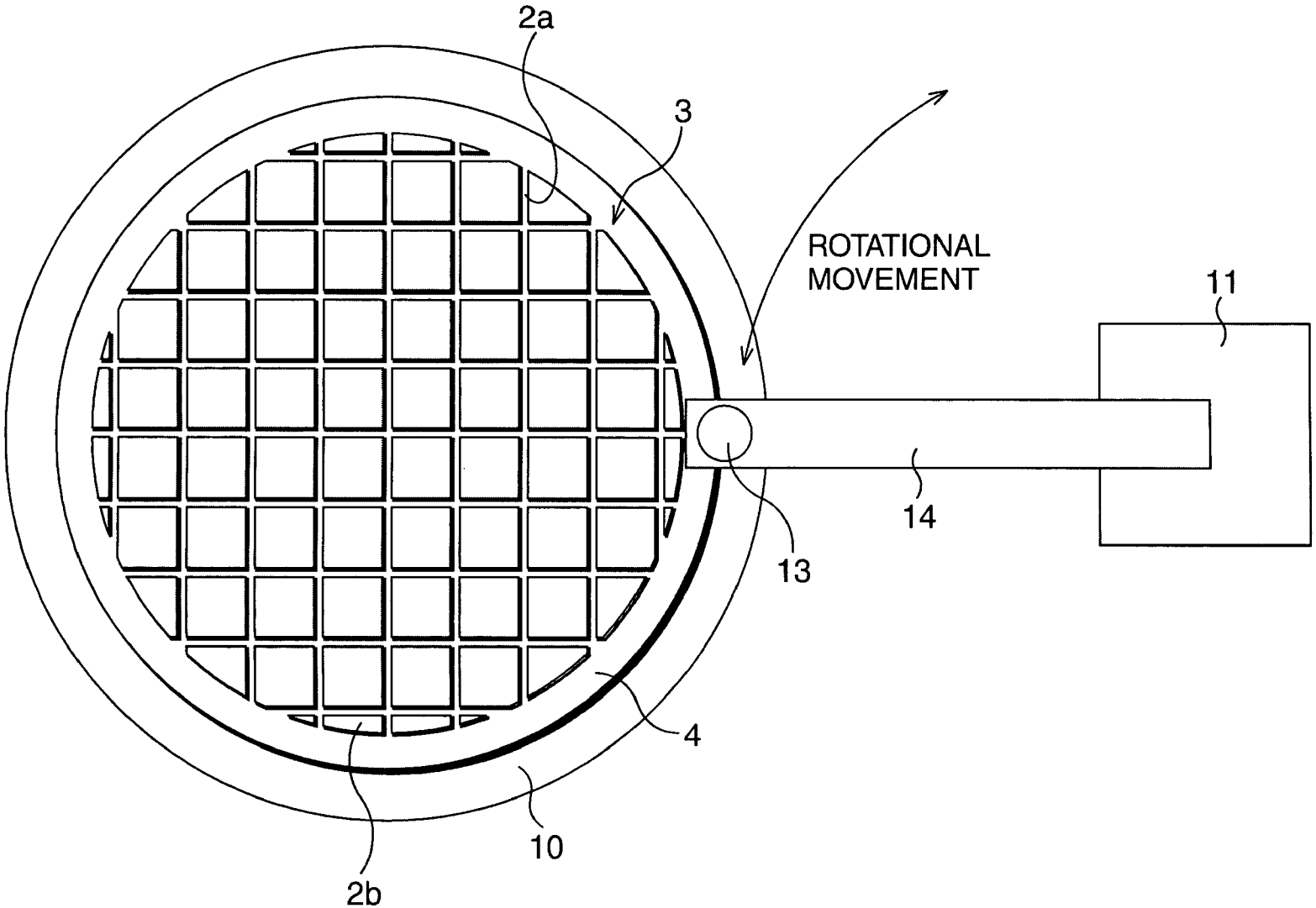
FIG. 3 is a top view showing the bonding apparatus for the polishing pad.

Next, a bonding apparatus for the polishing pad suitable for pressing the outer peripheral portion 4 will be described. FIG. 2 is a front view showing the bonding apparatus for the polishing pad, and FIG. 3 is a top view showing the bonding apparatus.

The bonding apparatus for the polishing pad includes a motor 11, an arm 14 moved rotatively by the motor 11, a cylinder 13 attached to a tip of the arm 14, a support member 15 provided as a cylinder head of the cylinder 13, and a bonding jig 12 rotatably supported by the support member 15. Incidentally, the bonding jig 12 may be fixed to the support member 15.

When the outer peripheral portion 4 is to be pressed to the surface plate 10, using the bonding apparatus thus structured, the motor 11 is first driven while the bonding jig 12 is held at a higher position than the front surface of the outer peripheral portion 4, so that the bonding jig 12 is moved to a position immediately above the outer peripheral portion 4. Next, the cylinder 13 is driven to move down the bonding jig 12, so that an appropriate pressure is applied to the outer peripheral portion 4.

The use of such a bonding apparatus makes it possible to effectively press the outer peripheral portion 4 to the surface plate 10, so that the polishing pad can be bonded to the surface plate 10 with high bondability.

Figure 4A:
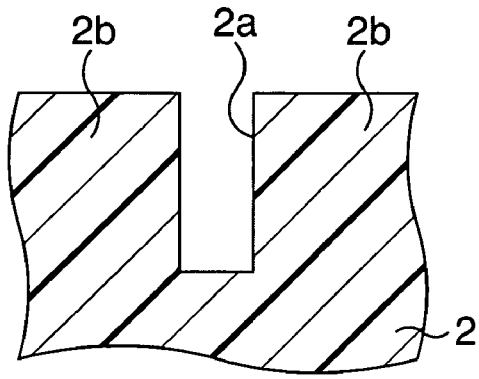
FIG. 4A to FIG. 4C are views showing cross-sectional shapes of a groove 2*a;*
Figure 4B:
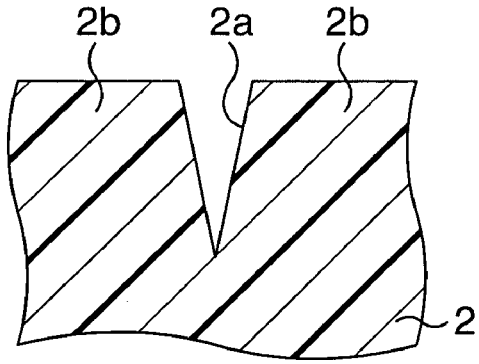
Figure 4C:
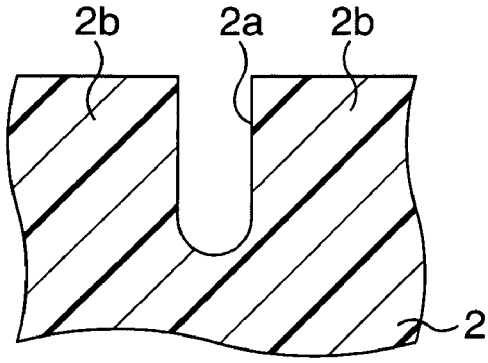

It should be noted that the cross-sectional shape of the grooves 2*a* is not limited to a specific one. For example, it may be a rectangular shape as shown in FIG. 4A, a V-shape as shown in FIG. 4B, or a U-shape as shown in FIG. 4C.

Figure 5A:
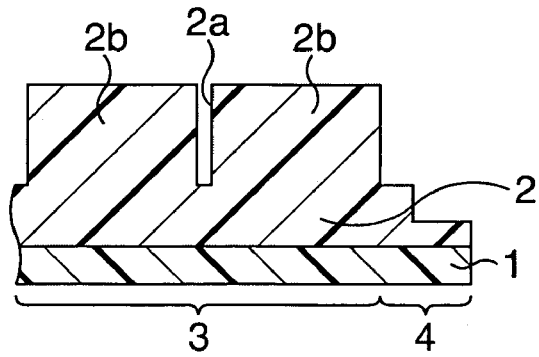
FIG. 5A to FIG. 5C are views showing shapes of an outer peripheral portion 4.
Figure 5B:
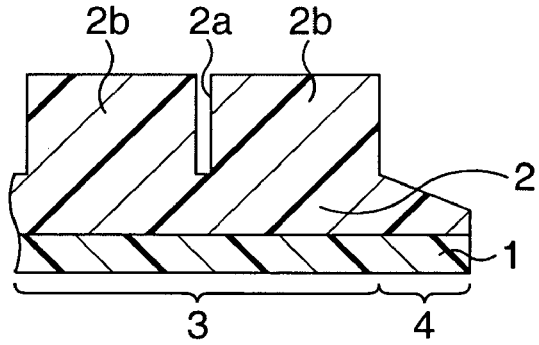
Figure 5C:
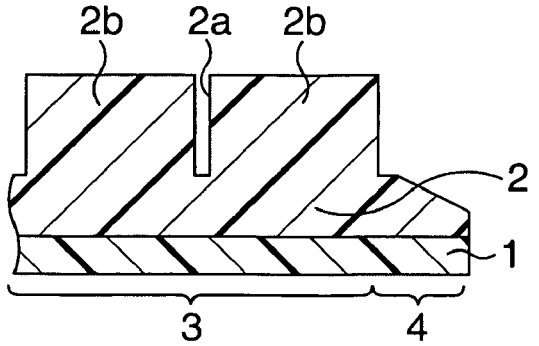
Figure 6A:
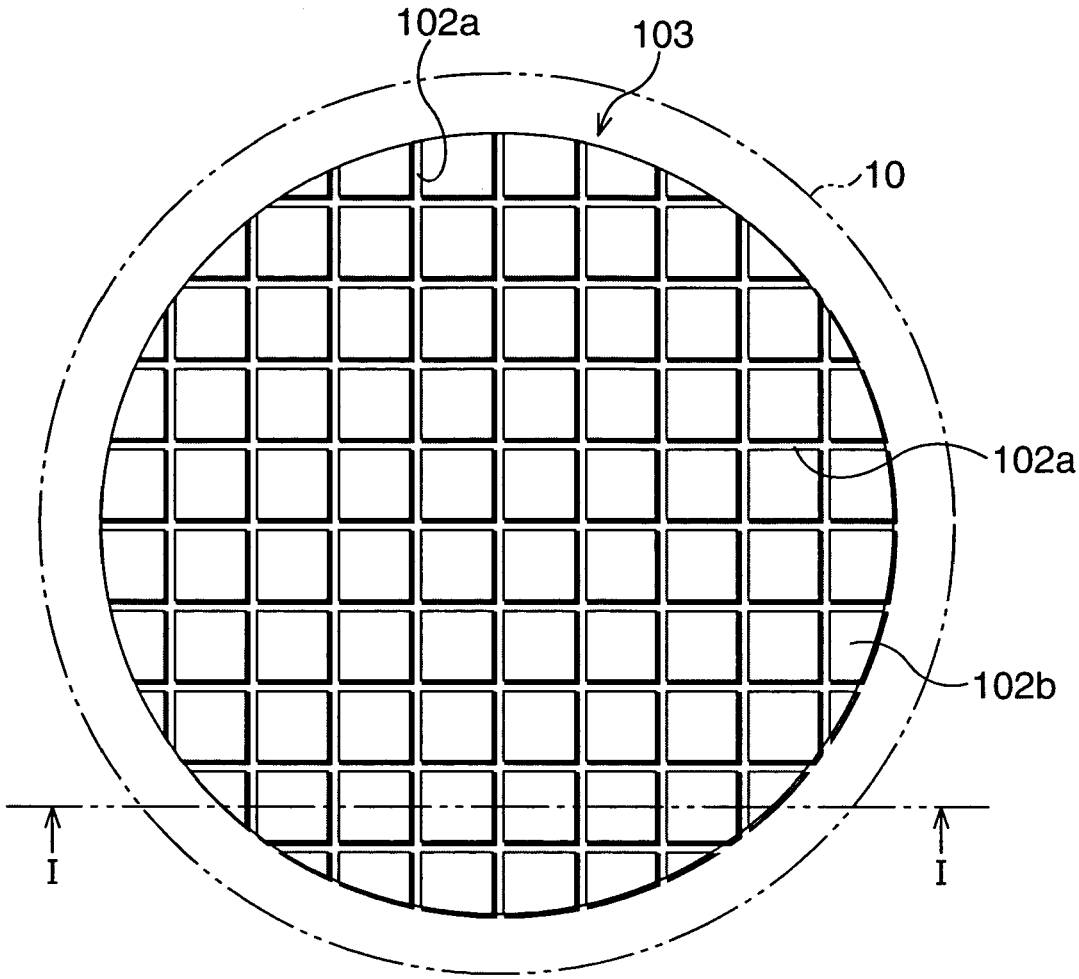
FIG. 6A PRIOR ART
FIG. 6A and FIG. 6B are schematic views showing an example of a conventional polishing pad (first conventional example)
Figure 6B:
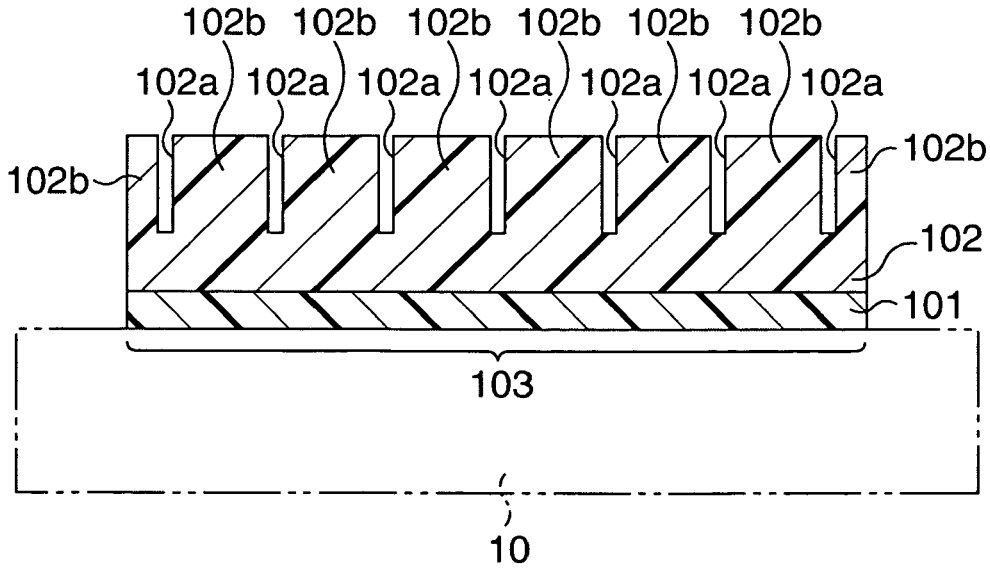
FIG. 6B PRIOR ART
Figure 7A:
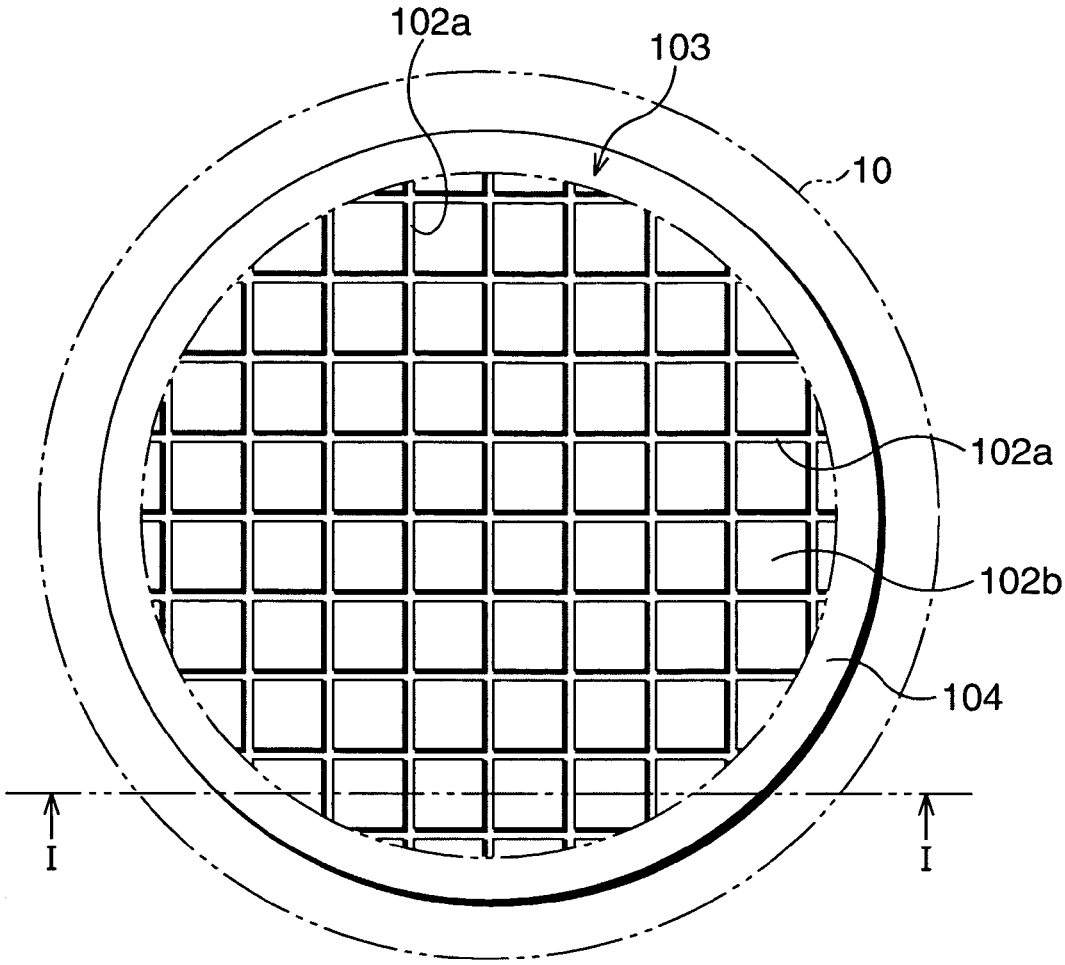
FIG. 7A PRIOR ART
FIG. 7A and FIG. 7B are schematic view showing another example of a conventional polishing pad (second conventional example).
Figure 7B:
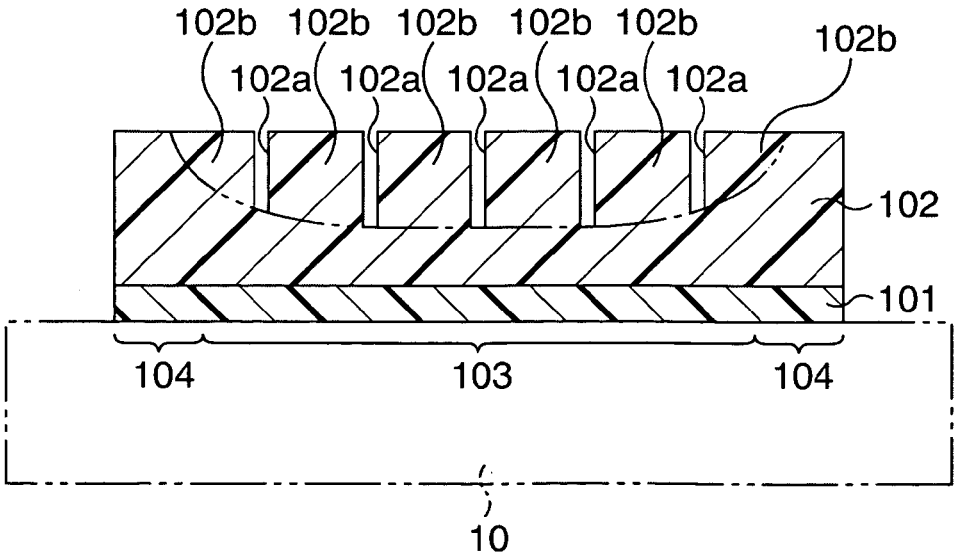
FIG. 7B PRIOR ART

The shape of the outer peripheral portion 4 is not limited to a specific one, either. For example, a step may be formed in the outer peripheral portion 4 as shown in FIG. 5A, or the front surface of the outer peripheral portion 4 may be inclined as shown in FIG. 5B. Alternatively, a portion with the same height as the bottom portions of the grooves 2*a* and an inclined portion may both exist as shown in FIG. 5C. When the outer peripheral portion 4 is formed to include the step or the inclination, the outer peripheral portion 4 can be pressed to the surface plate with, for example, a jig whose portion to be in contact with the outer peripheral portion 4 is formed to match the outer peripheral portion 4. Further, when the outer peripheral portion 4 is formed to include the inclination, a jig may be pressed from a direction perpendicular to an inclined surface.

As for the order of pressing for bonding the polishing pad to the surface plate, in the above-described method, the pressing of the outer peripheral portion 4 follows the pressing of the polishing portion 3, but they may be pressed concurrently. The pressing of the polishing portion 3 can follow the pressing of the outer peripheral portion 4, but this requires care since air may possibly enter between the polishing pad and the surface plate.

Further, even if the outer peripheral portion 4 is higher than the bottom portions of the grooves 2*a*, some degree of effect is obtainable as long as it is lower than the top portions of the projections 2*b*. However, in order to ensure higher bondability, the height of the outer peripheral portion 4 is preferably equal to or lower than the height of the bottom portions of the grooves 2*a*. When the outer peripheral portion 4 is higher than the grooves 2*a*, it is preferable to form grooves also in the outer peripheral portion 4, i.e., to form auxiliary grooves connecting with the grooves 2*a* as paths through which the slurry and the like staying in the grooves 2*a* are discharged.

According to the present invention, since an outer peripheral portion is easily bonded to a surface plate, bondability of a polishing pad is improved. This, as a result, prevents slurry and the like from easily entering between the polishing pad and the surface plate.

The present embodiments are to be considered in all respects as illustrative and no restrictive, and all changes which come within the meaning and range of equivalency of the claims are therefore intended to be embraced therein. The invention may be embodied in other specific forms without departing from the spirit or essential characteristics thereof.

What is claimed is:

1. A polishing pad comprising:

a polishing portion having a plurality of projections that are brought into contact with an object to be polished and grooves formed between said plurality of projections; and an outer peripheral portion provided around said polishing portion and having a front surface lower in height than top portions of said projections.

2. The polishing pad, according to claim 1, wherein the height of the front surface of said outer peripheral portion is equal to or lower than a height of bottom portions of said grooves.

3. The polishing pad according to claim 1, wherein the height of the front surface of said outer peripheral portion is higher than a height of bottom portions of said grooves, and auxiliary grooves connecting with said grooves are formed in said outer peripheral portion.

4. The polishing pad according to claim 1, wherein the front surface and a rear surface of said outer peripheral portion are parallel with each other.

5. The polishing pad according to claim 1, being to be attached to a chemical mechanical polishing apparatus.

6. The polishing pad according to claim 1, containing foamed urethane as a material.

7. The polishing pad according to claim 1, wherein the front surface of said outer peripheral portion has an inclined surface whose height closer to an outer side is lower.

8. The polishing pad according to claim 1, wherein said plurality of projections have a substantially equal height.

9. The polishing pad according to claim 1, wherein said grooves have a substantially equal depth.

10. The polishing pad according to claim 1, wherein said grooves are formed in grid pattern in said polishing portion.

11. A polishing apparatus comprising the polishing pad according to claim 1.

* * * * *